US007030548B2

(12) United States Patent
Ueno et al.

(10) Patent No.: US 7,030,548 B2
(45) Date of Patent: Apr. 18, 2006

(54) CATHODE-RAY TUBE APPARATUS

(75) Inventors: Hirofumi Ueno, Tokyo (JP); Tsutomu Takekawa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/942,913

(22) Filed: Sep. 17, 2004

(65) Prior Publication Data

US 2005/0057196 A1 Mar. 17, 2005

Related U.S. Application Data

(63) Continuation of application No. PCT/JP04/00219, filed on Jan. 15, 2004.

(30) Foreign Application Priority Data

Jan. 15, 2003 (JP) ..... 2003-007102

(51) Int. Cl.
*H01J 29/50* (2006.01)
*H01J 29/58* (2006.01)

(52) U.S. Cl. ..... 313/414; 315/382

(58) Field of Classification Search ..... 315/395, 315/382, 382.1, 383; 313/414, 413, 415, 313/412

See application file for complete search history.

(56) References Cited

U.S. PATENT DOCUMENTS

| | | | | |
|---|---|---|---|---|
| 4,764,704 | A * | 8/1988 | New et al. | 313/414 |
| 5,663,609 | A * | 9/1997 | Kamohara et al. | 313/412 |
| 6,404,149 | B1 * | 6/2002 | Ueno et al. | 315/382 |
| 6,456,018 | B1 * | 9/2002 | Bae et al. | 315/382 |
| 6,744,191 | B1 * | 6/2004 | Oda et al. | 313/414 |
| 6,756,748 | B1 * | 6/2004 | Bae et al. | 315/382 |
| 2001/0028212 | A1 * | 10/2001 | Kimiya et al. | 313/414 |
| 2002/0047508 | A1 * | 4/2002 | Satou et al. | 313/364 |
| 2003/0214260 | A1 * | 11/2003 | Cho | 315/368.11 |

FOREIGN PATENT DOCUMENTS

| | | |
|---|---|---|
| JP | 3-93135 | 4/1991 |
| JP | 4-315736 | 11/1992 |
| JP | 7-130299 | 5/1995 |
| JP | 7-147145 | 6/1995 |
| JP | 2000-331624 | 11/2000 |
| JP | 2001-84921 | 3/2001 |
| JP | 2002-279916 | 9/2002 |

* cited by examiner

*Primary Examiner*—Wilson Lee
*Assistant Examiner*—Angela M Lie
(74) *Attorney, Agent, or Firm*—Oblon, Spivak, McClelland, Maier & Neustradt, P.C.

(57) ABSTRACT

A prefocus lens section is formed by a second grid and a third grid in a substantially rotation-symmetric fashion. A sub-lens section is formed by the third grid and a first segment. A main lens section is formed by a fourth grid and a fifth grid. The third grid is supplied with a voltage that is higher than a focus voltage and lower than an anode voltage. An electron beam, which is prior to entering the main lens section, is shaped to have a greater horizontal dimension than a vertical dimension.

21 Claims, 5 Drawing Sheets

CATHODE-RAY TUBE APPARATUS

CROSS-REFERENCE TO RELATED APPLICATIONS

This is a Continuation Application of PCT Application No. PCT/JP04/00219, filed Jan. 15, 2004, which was published under PCT Article 21(2) in Japanese.

This application is based upon and claims the benefit of priority from the prior Japanese Patent Application No. 2003-007102, filed Jan. 15, 2003, the entire contents of which are incorporated herein by reference.

BACKGROUND OF THE INVENTION

1. Field of the Invention

The present invention relates to a cathode-ray tube apparatus, and more particularly to a color cathode-ray tube apparatus that is configured to form a fine beam spot on an entire phosphor screen and to stably provide a good image quality with high resolution.

2. Description of the Related Art

In recent years, with an increasing popularity of Hi-Vision broadcast and Internet TV, there is a demand for exact reproduction of an image with higher definition. In order to meet the demand, it is necessary to make pixels finer. In order to display a high-definition image, it is required to form a small-sized beam spot with less distortion over the entire phosphor screen.

In a generally known method for forming a small beam spot on the phosphor screen, a virtual object point size of an electron beam is reduced (see, e.g. Jpn. Pat. Appln. KOKAI Publication No. 2000-331624). Specifically, of the electrodes that constitute a prefocus lens, the third grid is connected to a resistor for dividing an anode voltage. Thereby, the third grid is supplied with a high voltage. The second grid of the prefocus lens is supplied with a low voltage. Hence, a large potential difference is provided between the second grid and the third grid. In short, a prefocus lens with a strong prefocus function is formed.

Thereby, a great potential permeation occurs into an electron beam passage hole in the second grid G2, and a function for reducing the virtual object point size can be realized. Accordingly, a small beam spot can be formed on the phosphor screen. Moreover, a divergence angle of the electron beam can be reduced by the strong prefocus function. Therefore, the effect of aberration at the time the beam passes through the main lens can be reduced.

In the meantime, in a color cathode-ray tube apparatus that employs an in-line electron gun assembly for generating three electron beams arranged in line in the horizontal direction, the deflection yoke is configured to generate non-uniform deflection magnetic fields. Due to the deflection magnetic fields, a haze of the beam spot appears on the phosphor screen, in particular, on a peripheral region of the screen.

In order to reduce the haze, a method of forming a prefocus lens, which has an astigmatic function with a stronger focusing power in the vertical direction than in the horizontal direction, is generally adopted. In some examples of this method, a horizontally elongated slit is formed at a peripheral region of the electron beam passage hole on the third grid-side part of the second grid, or a vertically elongated slit is formed at a peripheral region of the electron beam passage hole on the second grid-side part of the third grid.

However, if the method of applying a high voltage to the third grid and increasing the permeation of potential into the electron beam passage hole in the second grid is adopted in order to form a small beam spot and if the method of forming the slit at the peripheral region of the electron beam passage hole in the second grid or the third grid to provide astigmatism is adopted in order to reduce the haze of the beam spot, the astigmatic function is intensified in accordance with an increase in the lens power of the prefocus lens.

In other words, the electron beam that passes through the prefocus lens is vertically overfocused and horizontally excessively diverged. As a result, the beam spot on the phosphor screen is distorted and the image quality deteriorates.

To cope with this, the astigmatic function can be designed to decrease by reducing the depth of the slip that is formed in the second grid or the third grid. However, if the depth of the slit in the second grid or the third grid is decreased and the strong prefocus lens is formed, a variation in beam spot shape becomes sensitive to non-uniformity in precision of slit formation or precision in assembly of the electron gun. Consequently, such a problem arises that degradation in image quality tends to easily occur. As a result, it becomes difficult to stably obtain a high image quality.

As has been described above, in the color cathode-ray tube apparatus, in order to display a high-quality image with high definition and high resolution, it is necessary to form a small beam spot with little elliptical distortion over the entire phosphor screen. In addition, in order to realize such a performance, it is necessary to stably manufacture color cathode-ray tube apparatuses with little non-uniformity.

In order to achieve this, the high-voltage side electrode (e.g. third grid) of the prefocus lens is supplied with a high voltage (e.g. a voltage that is higher than the potential of the low-voltage side electrode of the main lens and is lower than the voltage of the high-voltage side electrode of the main lens). Thereby, the lens power is increased, and the permeation voltage, which permeates to the electron beam passage hole in the low-voltage side electrode (e.g. second grid) of the prefocus lens, is increased. Thus, a small beam spot can be formed on the phosphor screen.

However, a variation in lens power per unit dimension of the electrodes of the prefocus lens increases. Consequently, if a slit structure for providing an astigmatic function is added to the electrode of the prefocus lens, the intensity of the prefocus lens action becomes non-uniform, and it becomes impossible to stably form a beam spot with a good shape. In short, the above-described methods cannot provide a sufficiently small beam spot with stable characteristics.

BRIEF SUMMARY OF THE INVENTION

The present invention has been made in consideration of the above-described problems, and its object is to provide a cathode-ray tube apparatus capable of stably displaying a high-definition, high-resolution image.

According to a first aspect of the present invention, there is provided a cathode-ray tube apparatus comprising:

an electron gun assembly including an electron beam generating section that generates an electron beam, a prefocus lens section that accelerates and prefocuses the electron beam generated from the electron beam generating section, a sub-lens section that further prefocuses the electron beam that is prefocused by the prefocus lens section, and a main lens section that accelerates and focuses the electron beam, which is prefocused by the sub-lens section, onto a phosphor screen; and a deflection yoke that generates deflection magnetic fields for deflecting the electron beam, which is emitted from the electron gun assembly, in a horizontal direction and a vertical direction, wherein the prefocus lens section is formed by at least a screen electrode and a first focus electrode to which a voltage with a first level is applied, and the prefocus lens section is formed in a substantially rotation-symmetric fashion with respect to a direction of travel of the electron beam, the sub-lens section is formed by at least the first focus electrode and a second focus electrode to which a voltage with a second level that is lower than the first level is applied, the main lens section is formed by at least the second focus electrode and an anode electrode to which a voltage with a third level that is higher than the first level is applied, and the electron gun assembly includes an asymmetric electron lens section that makes a horizontal dimension of the electron beam, which is prior to entering the main lens section, greater than a vertical dimension thereof.

According to a second aspect of the present invention, there is provided a cathode-ray tube apparatus comprising:

an electron gun assembly including an electron beam generating section that generates an electron beam, a prefocus lens section that accelerates and prefocuses the electron beam generated from the electron beam generating section, a sub-lens section that further prefocuses the electron beam that is prefocused by the prefocus lens section, and a main lens section that accelerates and focuses the electron beam, which is prefocused by the sub-lens section, onto a phosphor screen; and a deflection yoke that generates deflection magnetic fields for deflecting the electron beam, which is emitted from the electron gun assembly, in a horizontal direction and a vertical direction, wherein the prefocus lens section is formed by at least a screen electrode and a first focus electrode to which a voltage with a first level is applied, and the prefocus lens section is formed in a substantially rotation-symmetric fashion with respect to a direction of travel of the electron beam, the sub-lens section is formed by at least the first focus electrode, a second focus electrode to which a voltage with a second level that is lower than the first level is applied, and an intermediate electrode that is disposed between the first focus electrode and the second focus electrode, the main lens section is formed by at least the second focus electrode and an anode electrode to which a voltage with a third level that is higher than the first level is applied, the intermediate electrode is electrically connected to the screen electrode, and a voltage with a fourth level that is lower than the second level is applied to the intermediate electrode and the screen electrode, and the electron gun assembly includes an asymmetric electron lens section that makes a horizontal dimension of the electron beam, which is prior to entering the main lens section, greater than a vertical dimension thereof.

DETAILED DESCRIPTION OF THE INVENTION

A cathode-ray tube apparatus according to an embodiment of the present invention will now be described with reference to the accompanying drawings.

Figure 1:
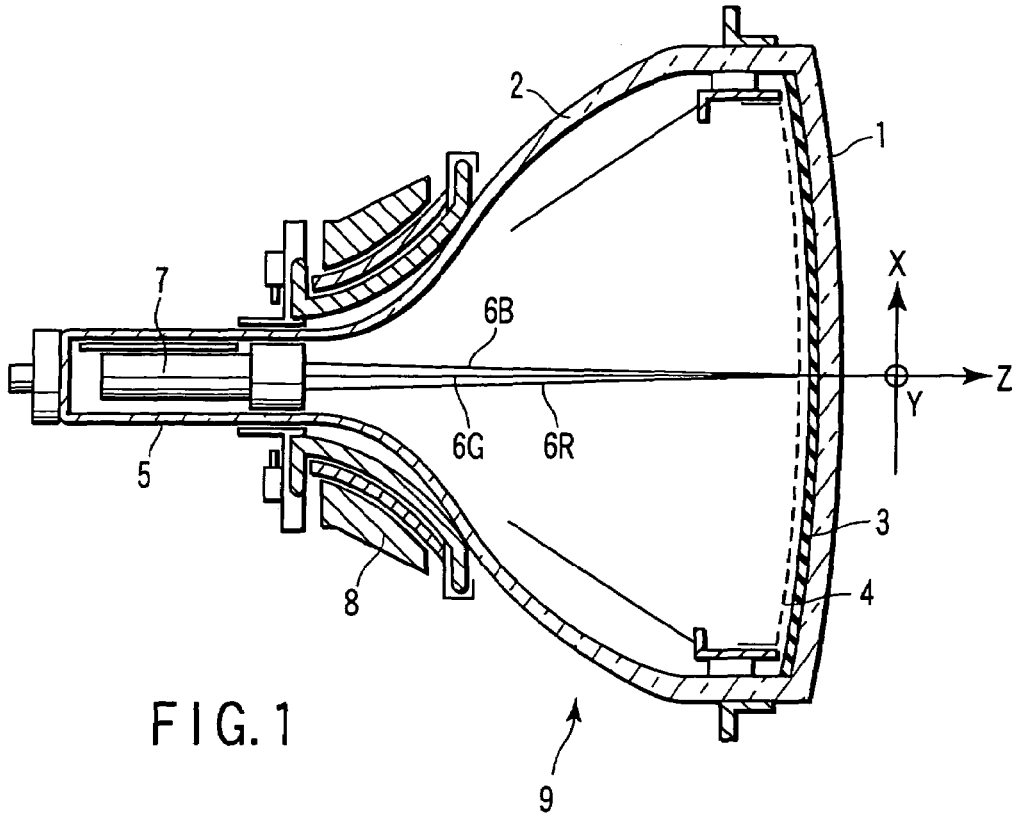
FIG. 1 is a horizontal cross-sectional view that schematically shows the structure of a color cathode-ray tube apparatus according to an embodiment of the present invention.

As is shown in FIG. 1, the cathode-ray tube apparatus, i.e. a self-convergence type in-line color cathode-ray tube apparatus, has a vacuum envelope 9 that is formed of glass. The vacuum envelope 9 includes a panel 1 and a funnel 2 that is integrally coupled to the panel 1. A phosphor screen 3 is disposed on an inside surface of the panel 1. The phosphor screen 3 has three-color striped or dot-shaped phosphor layers, which emit blue, green and red light. A shadow mask 4 is disposed to face the phosphor screen 3. The shadow mask 4 has many electron beam passage apertures in its inside part.

An in-line electron gun assembly 7 is disposed within a cylindrical neck 5, which corresponds to a thinnest portion of the funnel 2. The electron gun assembly 7 emits three electron beams 6B, 6G and 6R, which comprise a center beam 6G and a pair of side beams 6B and 6R that travel in the same horizontal plane.

A deflection yoke 8 is mounted on an outer surface of the funnel 2, which extends from a large-diameter portion of the funnel 2 to the neck 5. The deflection yoke 8 generates non-uniform deflection magnetic fields for deflecting the three electron beams 6B, 6G and 6R, which have been emitted from the electron gun assembly 7, in a horizontal direction (X) and a vertical direction (Y). The non-uniform deflection magnetic fields comprise a pincushion-shaped horizontal deflection magnetic field and a barrel-shaped vertical deflection magnetic field.

In the color cathode-ray tube apparatus, the three electron beams 6B, 6G and 6R emitted from the electron gun assembly 7 are self-converged near the electron beam passage apertures in the shadow mask 4 and are deflected by the non-uniform deflection magnetic fields generated by the deflection yoke 8. Thereby, the three electron beams 6R, 6G and 6B are scanned over the phosphor screen 3 through the shadow mask 4 in the horizontal direction X and vertical direction Y. At this time, each electron beam is shaped and landed on the phosphor layer of a specified color. Thus, a color image is displayed.

Figure 2:
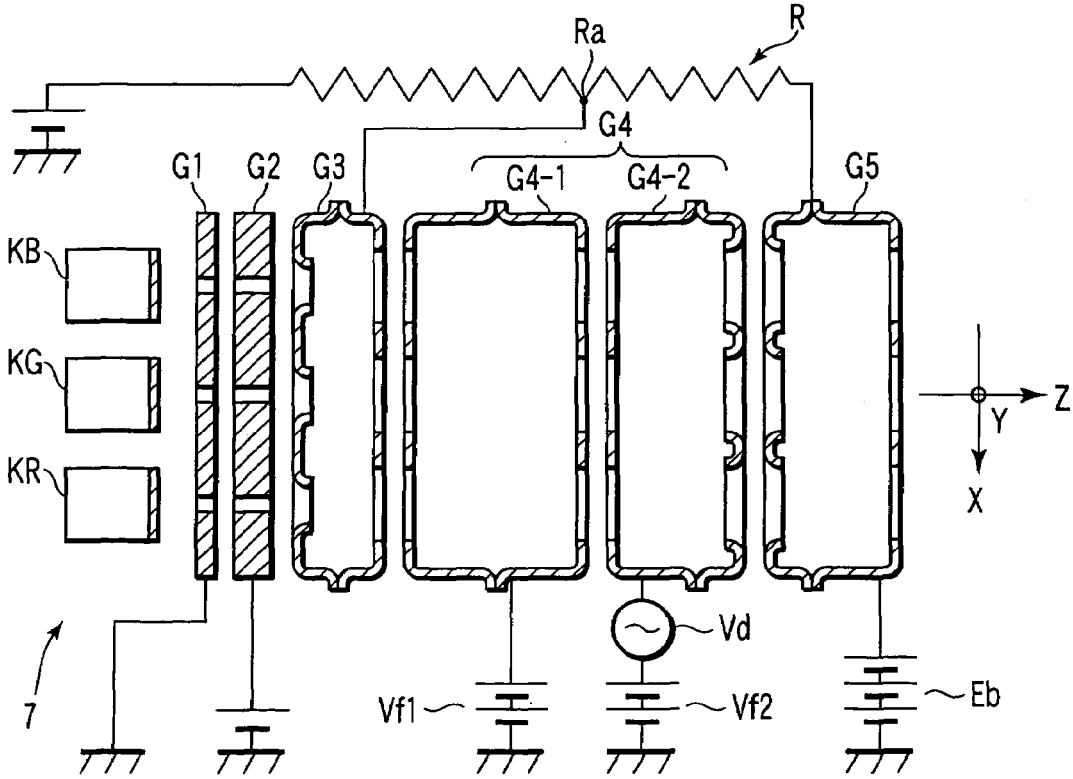
FIG. 2 is a horizontal cross-sectional view that schematically shows the structure of an electron gun assembly, which is applicable to the cathode-ray tube apparatus shown in FIG. 1.

As is shown in FIG. 2, the electron gun assembly 7 includes three cathodes K (R, G, B) disposed in line in the horizontal direction X, three heaters for individually heating the cathodes K (R, G, B), and six electrodes. The six electrodes, that is, a first grid (grid electrode) G1, a second grid (screen electrode) G2, a third grid (first focus electrode) G3, a fourth grid (second focus electrode) G4 and a fifth grid (anode electrode) G5, are disposed in succession from the cathodes K (R, G, B) side toward the phosphor screen in a tube axis direction Z. The fourth grid G4 comprises at least two segments, that is, a first segment G4-1 and a second segment G4-2, which are disposed in succession in the tube axis direction Z. The cathodes K (R, G, B) and the six electrodes are integrally fixed by a pair of insulating support members.

Figure 3A:
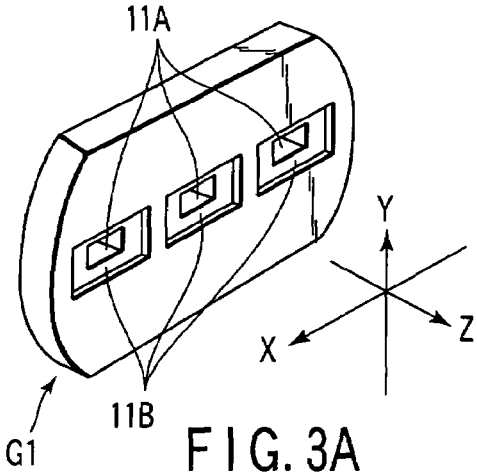
FIG. 3A is a perspective view that schematically shows the structure of a first grid, which is applicable to the electron gun assembly shown in FIG. 2.

The first grid G1 is formed of a plate electrode. The plate electrode has, in its plate face, three electron beam passage holes, which are formed in line in the horizontal direction X in association with the three cathodes K (R, G, B). Specifically, as shown in FIG. 3A, the first grid G1 has horizontally elongated electron beam passage holes 11A each having a greater horizontal dimension than a vertical dimension. In this embodiment, each electron beam passage hole 11A has a horizontally elongated rectangular shape having a long side in the horizontal direction X and a short side in the vertical direction Y.

In addition, the first grid G1 has slits 11B in its surface opposed to the second grid G2 at peripheral regions of the electron beam passage holes 11A, each slit 11B being elongated in the horizontal direction X. In this embodiment, each slit 11B has a horizontally elongated rectangular shape. The slit 11B has a long side in the horizontal direction X, which is greater than the horizontal dimension of the electron beam passage hole 11A, and a short side in the vertical direction Y, which is greater than the vertical dimension of the electron beam passage hole 11A.

Figure 3B:
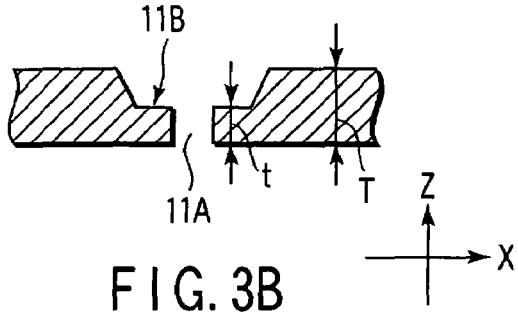
FIG. 3B is a cross-sectional view that schematically shows the structure of a peripheral region of an electron beam passage hole in the first grid shown in FIG. 3A.

The first grid G1, as shown in FIG. 3B, is composed of a plate electrode having a plate thickness T of, e.g. less than 1 mm. In this embodiment, the plate thickness T is 0.15 mm to 0.20 mm. The electron beam passage hole 11A has a horizontal dimension of about 0.6 mm, and a vertical dimension of, e.g. 0.4 mm. A plate thickness t of the peripheral part of the electron beam passage hole 11A, where the slit 11B is formed, is about 30% to 60% of the plate thickness T. In this embodiment, the plate thickness t is 0.06 mm to 0.09 mm.

Figure 4:
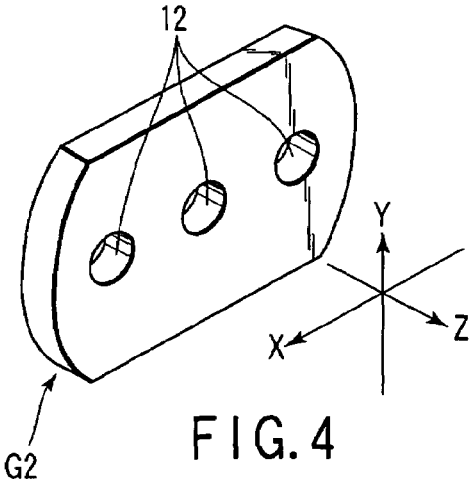
FIG. 4 is a perspective view that schematically shows the structure of a second grid, which is applicable to the electron gun assembly shown in FIG. 2.

The second grid G2 is formed of a plate electrode. The plate electrode has, in its plate face, three electron beam passage holes, which are formed in line in the horizontal direction X in association with the three cathodes K (R, G, B). Specifically, as shown in FIG. 4, the second grid G2 has circular electron beam passage holes 12.

Figure 5:
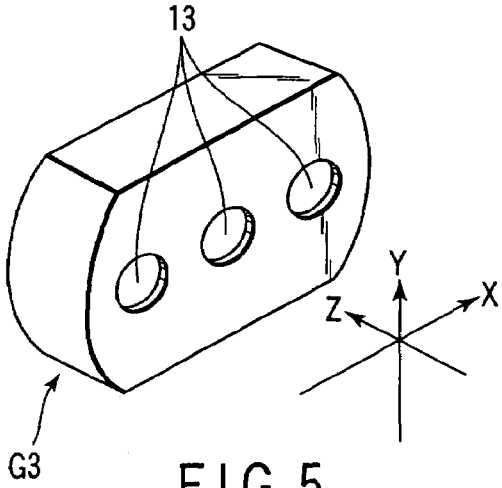
FIG. 5 is a perspective view that schematically shows the structure of a third grid, which is applicable to the electron gun assembly shown in FIG. 2.

The third grid G3 comprises an integrally formed cylindrical electrode. The cylindrical electrode has, in each of its faces opposed to the second grid G2 and fourth grid G4, three electron beam passage holes, which are formed in line in the horizontal direction X in association with the three cathodes K (R, G, B). Specifically, as shown in FIG. 5, the third grid G3 has circular electron beam passage holes 13 in its face opposed to the second grid G2, which are slightly greater than the electron beam passage holes 12. In addition, the third grid G3 has circular electron beam passage holes 13 in its face opposed to the fourth grid G4, which are greater than the electron beam passage holes 13.

The first segment G4-1 of the fourth grid G4 comprises an integrally formed cylindrical electrode. The cylindrical electrode has, in each of its faces opposed to the third grid G3 and the second segment G4-2, three electron beam passage holes, which are formed in line in the horizontal direction X in association with the three cathodes K (R, G, B). In this embodiment, the electron beam passage holes that are formed in the face opposed to the third grid G3 have circular shapes, and the electron beam passage holes that are formed in the face opposed to the second segment G4-2 have vertically elongated shapes each having a major axis in the vertical direction Y.

The second segment G4-2 of the fourth grid G4 comprises an integrally formed cylindrical electrode. The cylindrical electrode has, in each of its faces opposed to the first segment G4-1 and the fifth electrode G5, three electron beam passage holes, which are formed in line in the horizontal direction X in association with the three cathodes K (R, G, B). In this embodiment, the electron beam passage holes that are formed in the face opposed to the first segment G4-1 have horizontally elongated shapes each having a major axis in the horizontal direction X, and the electron beam passage holes that are formed in the face opposed to the fifth grid G5 have circular shapes.

The fifth grid G5 comprises an integrally formed cylindrical electrode. The cylindrical electrode has, in each of its faces opposed to the second segment G4-2 and the phosphor screen, three electron beam passage holes, which are formed in line in the horizontal direction X in association with the three cathodes K (R, G, B). In this embodiment, the electron beam passage holes that are formed in both end faces of the cylindrical electrode have circular shapes.

In the electron gun assembly 7 with the above-described structure, a voltage that is produced by superimposing a video signal on a DC voltage of about 190 V, is applied to the cathodes K. The first grid G1 is grounded. A DC voltage of about 800 V is applied to the second grid G2. A fixed DC voltage of about 8.0 kV, that is, a focus voltage Vf1, is applied to the first segment G4-1 of the fourth grid G4.

Figure 6:
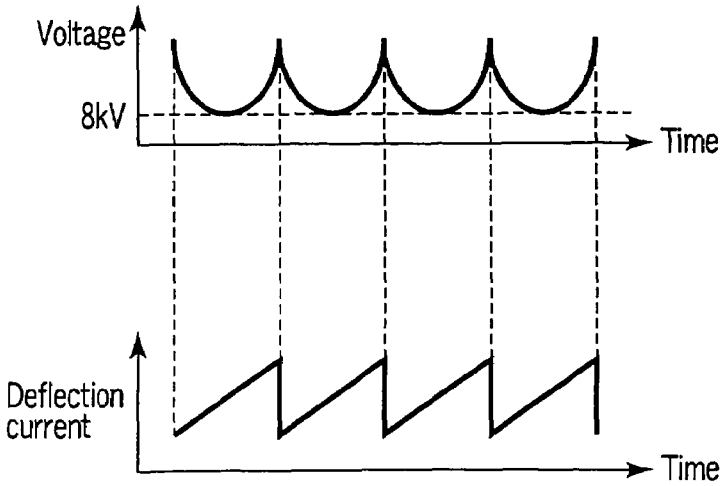
FIG. 6 is a view illustrating a relationship between a voltage, which is applied to a focus electrode in the electron gun assembly shown in FIG. 2, and a deflection current.

The second segment G4-2 of the fourth grid G4 is supplied with a dynamic focus voltage that is produced by superimposing a parabolically varying AC voltage component Vd on a fixed DC voltage Vf2 of about 8.0 kV, which is substantially equal to the focus voltage Vf1. This dynamic focus voltage, as shown in FIG. 6, varies in synchronism with a saw-tooth deflection current in a parabolic fashion in accordance with a variation in deflection amount of electron beams. The dynamic focus voltage takes a minimum value of about 8.0 kV and a maximum value of, e.g. about 9.0 kV. An anode voltage Eb of about 30 kV is applied to the fifth grid G5.

The third grid G3 is supplied with a voltage of, e.g. about 12.0 kV, which is higher than the focus voltage Vf1 and lower than the anode voltage Eb. The third grid G3 is connected to a resistor R that is disposed near the electron gun assembly 7 within the neck 5 of the cathode-ray tube apparatus. One end of the resistor R is electrically connected to the fifth grid G5, and the other end of the resistor R is grounded. A voltage, which is obtained by dividing the anode voltage Eb by means of the resistor R, is applied to the third grid G3. In this embodiment, the third grid G3 is connected to a voltage supply terminal Ra of the resistor R and is supplied with a voltage of a predetermined level via the resistor R.

In the electron gun assembly 7 having the above-described structure, the above-mentioned voltages are applied to the respective grids, thereby constituting an electron beam generating section, a prefocus lens section, a sub-lens section, and a main lens section.

To be more specific, the electron beam generating section is formed by the cathodes K, first grid G1 and second grid G2. The electron beam generating section generates electron beams and forms an object point for the main lens section. The prefocus lens section is formed by at least two electrodes, that is, the second grid G2 and third grid G3. The prefocus lens section is formed in a substantially rotation-symmetric fashion with respect to the direction of travel of the electron beams, accelerates the electron beams that are generated from the electron beam generating section, and prefocuses the electron beams with equal focusing powers in the horizontal direction X and vertical direction Y. In short, the prefocus lens section has no astigmatic function.

The sub-lens section is formed by at least two electrodes, that is, the third grid G3 and the first segment G4-1 of the fourth grid G4. The sub-lens section further prefocuses the prefocused electron beams and decreases the divergence angle. The main lens section is formed by the fourth grid G4 and the fifth grid G5. The main lens section accelerates the prefocused electron beams toward the phosphor screen 3 and ultimately focuses the electron beams on the associated phosphor layers.

When electron beams are deflected toward the peripheral area of the phosphor screen, a non-axial-symmetric lens section, which has different focusing powers in the horizontal direction X and vertical direction Y, is created between the first segment G4-1 and second segment G4-2 of the fourth grid G4. Specifically, at the time of deflection, the potential difference between the first segment G4-1 and second segment G4-2 increases in accordance with an increase in amount of deflection of electron beams. This potential difference takes a maximum value when the deflection angle of electron beams is maximum. The potential difference creates a quadrupole lens section between the first segment G4-1 and second segment G4-2, which has a focusing function in the horizontal direction X and a diverging function in the vertical direction Y. At the same time, a potential difference between the second segment G4-2 and the fifth grid G5 decreases, and the lens power of the main lens section weakens. In other words, as the electron beams are deflected toward the peripheral area of the phosphor screen, the distance between the electron gun assembly and the phosphor screen increases and the image point shifts farther. To cope with this phenomenon, the power of the main lens section is weakened and thus the defocusing of the electron beams is compensated.

In the electron gun assembly 7 with the above structure, the electron beam 6 (R, G, B) emitted from the associated cathode K (R, G, B) once forms a cross-over while passing through the first grid G1 and second grid G2, and also forms a virtual object point for the main lens section. In this case, the potential of the third grid G3 is set to be much higher than the potential of the second grid G2. Thus, the degree of potential permeation from the third grid G3 side into the electron beam passage hole 12 in the second grid G2 increases, and the formed virtual object point becomes sufficiently small.

Subsequently, the electron beam 6 (R, G, B) passes through the prefocus lens section that is created by the second grid G2 and third grid G3 and undergoes a prefocus function. At this time, since the potential of the third grid G3 is relatively high, the electron beam 6 (R, G, B) undergoes a strong focusing function both in the horizontal direction X and vertical direction Y, thus forming a small-size electron beam.

Further, the electron beam 6 (R, G, B) passes through the sub-lens section that is created by the third grid G3 and the first segment G4-1 of the fourth grid G4 and undergoes a further prefocus function. At the same time, the divergence angle of the electron beam 6 (R, G, B) is reduced, and an electron beam with a still smaller size can be formed.

Subsequently, the electron beam 6 (R, G, B), which travels to the peripheral area of the phosphor screen, passes through the quadrupole lens section that is created by the first segment G4-1 and second segment G4-2, and undergoes an action that compensates a deflection aberration. Specifically, the electron beam 6 (R, G, B) undergoes a focusing function in the horizontal direction X and a diverging function in the vertical direction Y. Thereby, horizontal distortion of the beam spot of the electron beam, which reaches the peripheral area of the phosphor screen, can effectively be improved. The electron beam 6 (R, G, B), which travels to the central area of the phosphor screen, enters the main lens section, without undergoing an action of the quadrupole lens section.

At last, the electron beam enters the main lens section that is created by the fourth grid G4 and fifth grid G5. Thereby, the electron beam 6 (R, G, B) is finally accelerated toward the phosphor screen and ultimately focused on the associated phosphor layer. Since a small-size electron beam is formed prior to entering the main lens section by the synergistic effect of the prefocus lens section and sub-lens section, the effect of the lens aberration of the main lens section is small and the beam spot size can be reduced. Accordingly, a beam spot with a sufficiently small size and little distortion can be formed on the phosphor screen.

In the present embodiment, the electron gun assembly 7 includes the asymmetric electron lens section that makes the horizontal dimension of the electron beam, which is prior to entering the main lens section, greater than the vertical dimension thereof. To be more specific, the electric field, which is produced between the first grid G1 with horizontally elongated electron beam passage holes 11A and horizontal slits 11B and the second grid G2, creates the asymmetric electron lens section that horizontally elongates the cross section of each electron beam.

The first grid G1 has both the horizontally elongated electron beam passage holes 11A and the horizontal slits 11B. However, if the first grid G1 has either the horizontally elongated electron beam passage holes 11A or the horizontal slits 11B, the asymmetric electron lens section can be created between the first grid G1 and second grid G2. By combining both the horizontally elongated electron beam passage holes 11A and the horizontal slits 11B, the function of the asymmetric lens section can be made more effective, and the lens action of this lens section can easily be adjusted.

Thereby, the electron beam 6 (R, G, B), which is generated by the electron beam generating section, undergoes, after emerging from the cathode K (R, G, B), a stronger focusing action in the vertical direction Y than in the horizontal direction X by the electric field that is produced between the first grid G1 and the second grid G2. Accordingly, the electron beam 6 (R, G, B) is shaped so as to have a horizontally elongated shape in a cross section perpendicular to the tube axis Z (i.e. a shape with a greater horizontal dimension than a vertical dimension), and the resultant beam 6 enters the prefocus lens section. Therefore, the effect of deflection aberration due to the deflection magnetic fields can be compensated, and degradation in the beam spot size on the phosphor screen can effectively be suppressed.

As has been described above, an astigmatic function is not provided in the prefocus lens section with a large potential difference, but an astigmatic function is provided between the first grid and the second grid in the electron beam generating section with a relatively small potential difference. Therefore, non-uniformity in the astigmatic function can be suppressed, relative to non-uniformity in processing precision of the first grid and the second grid. Even in mass-production, stable performances can be ensured.

Next, another embodiment of the invention will be described.

Figure 7:
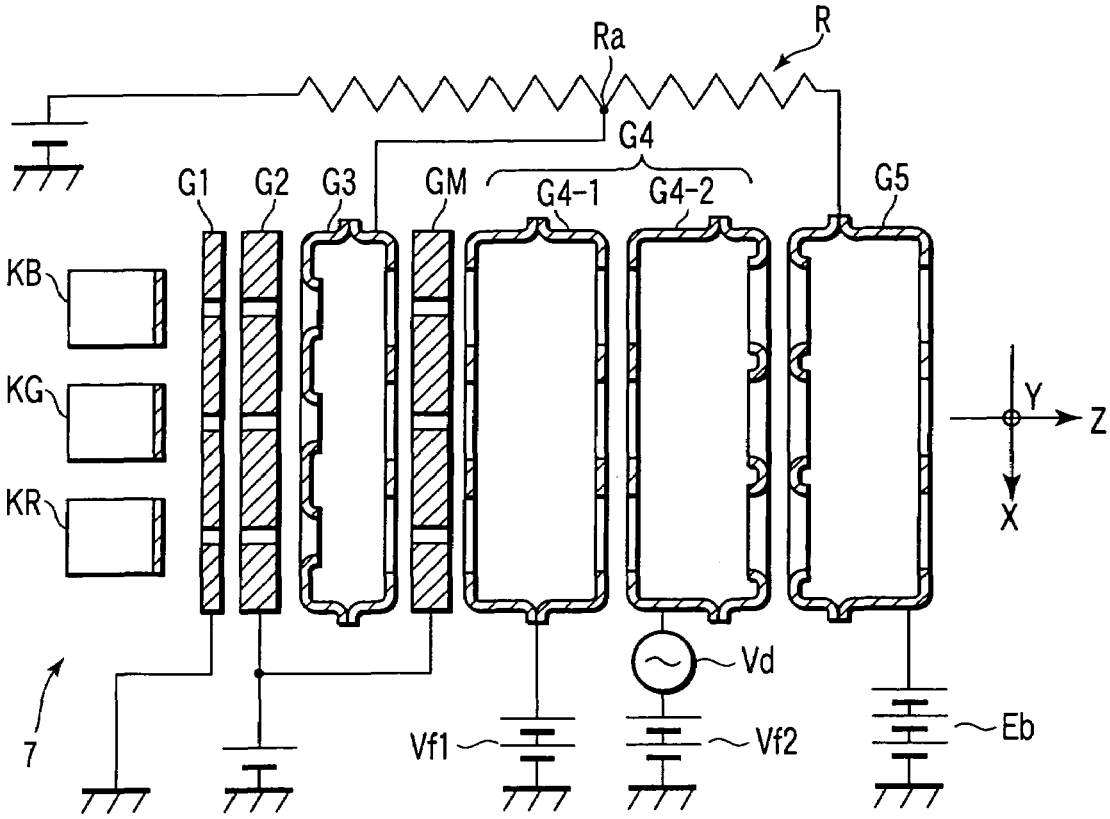
FIG. 7 is a horizontal cross-sectional view that schematically shows another structure of the electron gun assembly, which is applicable to the cathode-ray tube apparatus shown in FIG. 1.

For example, an electron gun assembly 7 shown in FIG. 7 includes, in addition to the structure of the electron gun assembly shown in FIG. 2, an intermediate electrode GM between the third grid G3, which constitutes the first focus electrode, and the first segment G4-1 of the fourth grid G4, which constitutes the second focus electrode.

The intermediate electrode GM is formed of a plate electrode. The plate electrode has, in its plate face, three electron beam passage holes, which are formed in line in the horizontal direction X in association with the three cathodes K (R, G, B). These electron beam passage holes have, e.g. circular shapes.

The intermediate electrode GM is electrically connected to the second grid G2. Specifically, the intermediate electrode GM, as well as the second grid G2, is supplied with a DC voltage of, e.g. about 800 V, which is lower than the focus voltage Vf1. The intermediate electrode GM, the third grid G3 and the first segment G4-1 form a sub-lens section.

According to the electron gun assembly with the above structure, in addition to the advantages of the above-described electron gun assembly, the lens power of the sub-lens section can further be increased. The electron beam can more effectively be prefocused before it enters the main lens section.

Figure 8:
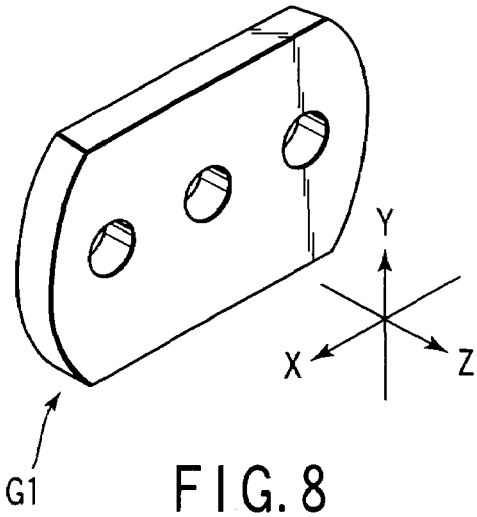
FIG. 8 is a perspective view that schematically shows the structure of a first grid, which is applicable to the electron gun assemblies shown in FIG. 2 and FIG. 7.

In the electron gun assembly 7 shown in FIG. 2, an asymmetric electron lens section may be formed by an electric field other than the electric field between the first grid G1 and second grid G2. Specifically, as shown in FIG. 8, the first grid G1 has neither horizontally elongated electron beam passage holes nor horizontal slits, but has circular electron beam passage holes.

Figure 9:
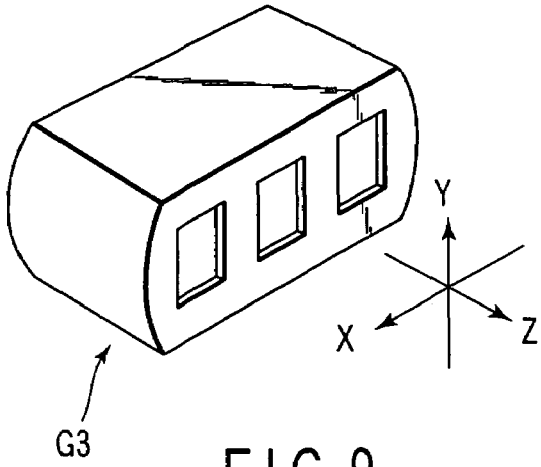
FIG. 9 is a perspective view that schematically shows the structure of a third grid, which is applicable to the electron gun assemblies shown in FIG. 2 and FIG. 7.
Figure 10:
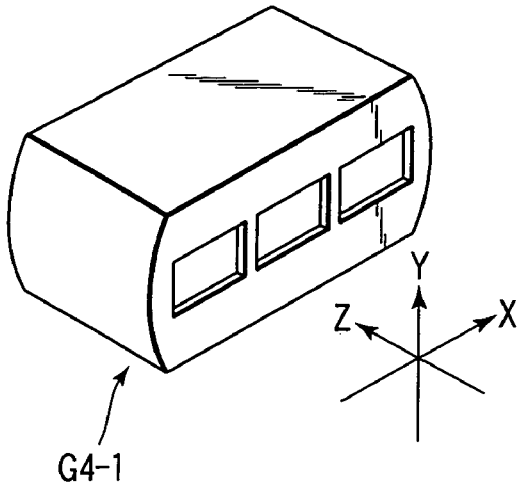
FIG. 10 is a perspective view that schematically shows the structure of a first segment, which is applicable to the electron gun assemblies shown in FIG. 2 and FIG. 7.

In this electron gun assembly 7, the sub-lens section may form an asymmetric electron lens section with astigmatism. Specifically, as shown in FIG. 9, the third grid G3 has, in its face opposed to the first segment G4-1, vertically elongated electron beam passage holes each having a greater vertical dimension than a horizontal dimension. In this embodiment, each of the electron beam passage holes in the third grid G3 has a vertically elongated rectangular shape having a short side in the horizontal direction X and a long side in the vertical direction Y. In addition, as shown in FIG. 10, the first segment G4-1 has, in its face opposed to the third grid G3, horizontally elongated electron beam passage holes each having a greater horizontal dimension than a vertical dimension. In this embodiment, each of the electron beam passage holes in the first segment G4-1 has a horizontally elongated rectangular shape having a long side in the horizontal direction X and a short side in the vertical direction Y.

With this structure, the sub-lens section has such a lens action that the focusing power in the vertical direction Y is stronger than the focusing power in the horizontal direction X.

The electron beam that is generated by the electron beam generating section passes through the prefocus lens section in the state in which the electron beam maintains a substantially circular cross section perpendicular to the tube axis Z. Then, the electron beam enters the sub-lens section. The electron beam undergoes a stronger focusing action in the vertical direction Y than in the horizontal direction X by the astigmatic function that is performed by the sub-lens section. Consequently, the electron beam, which is prior to entering the main lens section, has a horizontally elongated cross section perpendicular to the tube axis Z. Therefore, like the previously described embodiment, a beam spot with a sufficiently small size and little distortion can be formed on the phosphor screen, and a high-definition, high-resolution image can stably be displayed.

As has been described above, an astigmatic function is not provided in the prefocus lens section with a large potential difference, but an astigmatic function is provided between the third grid G3 and the first segment G4-1 in the sub-lens section with a relatively small potential difference. Therefore, non-uniformity in the astigmatic function can be suppressed, relative to non-uniformity in processing precision of the third grid and the first segment. Even in mass-production, stable performances can be ensured.

Figure 11:
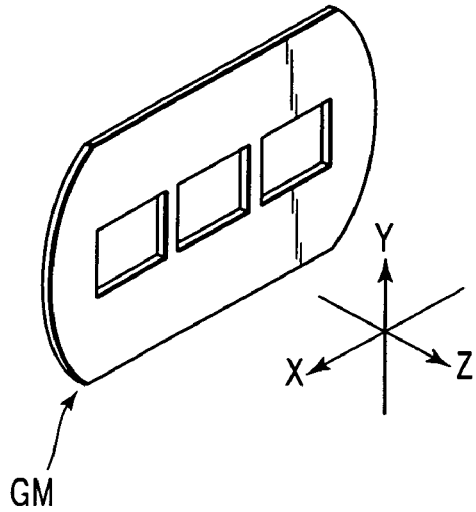
FIG. 11 is a perspective view that schematically shows the structure of an intermediate electrode, which is applicable to the electron gun assemblies shown in FIG. 2 and FIG. 7.

Similarly, in the electron gun assembly 7 shown in FIG. 7, an asymmetric electron lens section may be formed by an electric field other than the electric field between the first grid G1 and second grid G2. Specifically, as shown in FIG. 8, the first grid G1 has circular electron beam passage holes. The sub-lens section forms an asymmetric electron lens section with astigmatism, wherein the focusing power in the vertical direction Y is stronger than the focusing power in the horizontal direction X. The sub-lens section with such astigmatism is created by forming horizontally elongated electron beam passage holes, as shown in FIG. 11, in the intermediate electrode GM that is disposed between the third grid G3 and the first segment G4-1. In this embodiment, each of the electron beam passage holes in the intermediate electrode GM has a horizontally elongated rectangular shape having a long side in the horizontal direction X and a short side in the vertical direction Y. The intermediate electrode GM having such horizontally elongated electron beam passage holes may be combined with the third grid G3, which has the vertically elongated electron beam passage holes in its face opposed to the intermediate electrode GM, and the first segment G4-1. In this case, in addition to the advantages of the previously described electron gun assembly, the lens power of the sub-lens section can further be increased, and the electron beam can more effectively be subjected to the astigmatic function before it enters the main lens section.

With this structure, like the previously described embodiment, a beam spot with a sufficiently small size and little distortion can be formed on the phosphor screen, and a high-definition, high-resolution image can stably be displayed. Even in mass-production, stable performances can be ensured.

Figure 12:
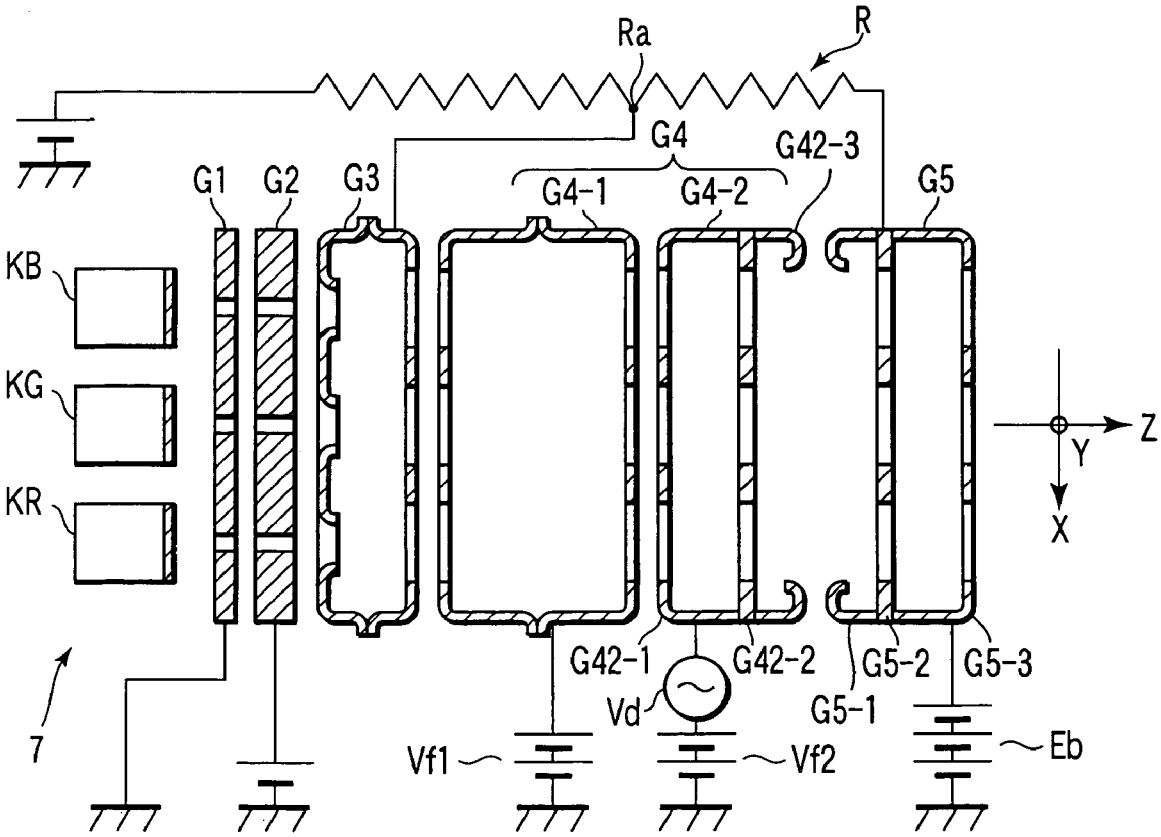
FIG. 12 is a horizontal cross-sectional view that schematically shows still another structure of the electron gun assembly, which is applicable to the cathode-ray tube apparatus shown in FIG. 1.

In the electron gun assembly 7 according to each of the above-described embodiments, the main lens section may be formed of an electric field extension type electron lens. Specifically, as shown in FIG. 12, the second segment G4-2 of the fourth grid G4 comprises two cylindrical electrodes and one electric field correction plate. That is, the second segment G4-2 is constructed by interposing an electric field correction plate G42-2 with electron beam passage holes between two cylindrical electrodes G42-1 and G42-3.

The first cylindrical electrode G42-1 is disposed to face the first segment G4-1. The first cylindrical electrode G42-1 has, in its face opposed to the first segment G4-1, three electron beam passage holes that are formed in line in the horizontal direction in association with the three cathodes K (R, G, B). The electric field correction plate G42-2 is a plate electrode that is disposed on the fifth grid G5 side of the first cylindrical electrode G42-1. The electric field correction plate G42-2 has, in its plate face, three electron beam passage holes that are formed in line in the horizontal direction in association with the three cathodes K (R, G, B). The second cylindrical electrode G42-3 is disposed on the fifth grid G5 side of the electric field correction plate G42-2. The second cylindrical electrode G42-3 has, in its face opposed to the fifth grid G5, an opening that commonly passes the three electrode beams.

The fifth grid G5 comprises two cylindrical electrodes and one electric field correction plate. Specifically, the fifth grid G5 is constructed by interposing an electric field correction plate G5-2 with electron beam passage holes between two cylindrical electrodes G5-1 and G5-3.

The first cylindrical electrode G5-1 is disposed to face the second segment G4-2. The first cylindrical electrode G5-1 has, in its face opposed to the second segment G4-2, an opening that commonly passes the three electrode beams. The electric field correction plate G5-2 is a plate electrode that is disposed on the phosphor screen side of the first cylindrical electrode G5-1. The electric field correction plate G5-2 has, in its plate face, three electron beam passage holes that are formed in line in the horizontal direction in association with the three cathodes K (R, G, B). The second cylindrical electrode G5-3 is disposed on the phosphor screen side of the electric field correction plate G5-2. The second cylindrical electrode G5-3 has, in its end face opposed to the phosphor screen, three electron beam passage holes that are formed in line in the horizontal direction in association with the three cathodes K (R, G, B).

Figure 13:
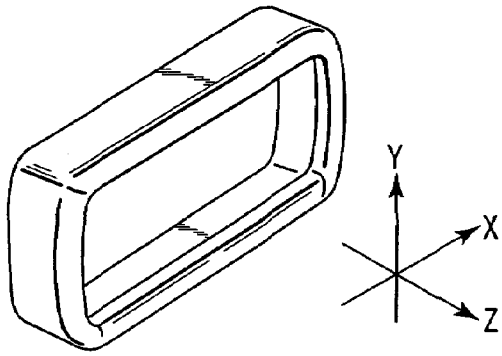
FIG. 13 is a perspective view that schematically shows the structure of a cylindrical member, which is applied to the electron gun assembly shown in FIG. 12.

Each of the second cylindrical electrode G42-3 of the second segment G4-2 and the first cylindrical electrode G5-1 of the fifth grid G5 is formed of a cylindrical body, as shown in FIG. 13. In the case of forming an electric field extension type main lens, it should suffice if at least a part of the electrodes of the main lens section has a cylindrical body. In the case of the electron gun assembly shown in FIG. 12, at least one of the fifth grid G5 side face of the second segment G4-2 and the second segment G4-2 side face of the fifth grid G5 may be provided with a cylindrical body that extends in the direction of travel of electron beams.

Figure 14:
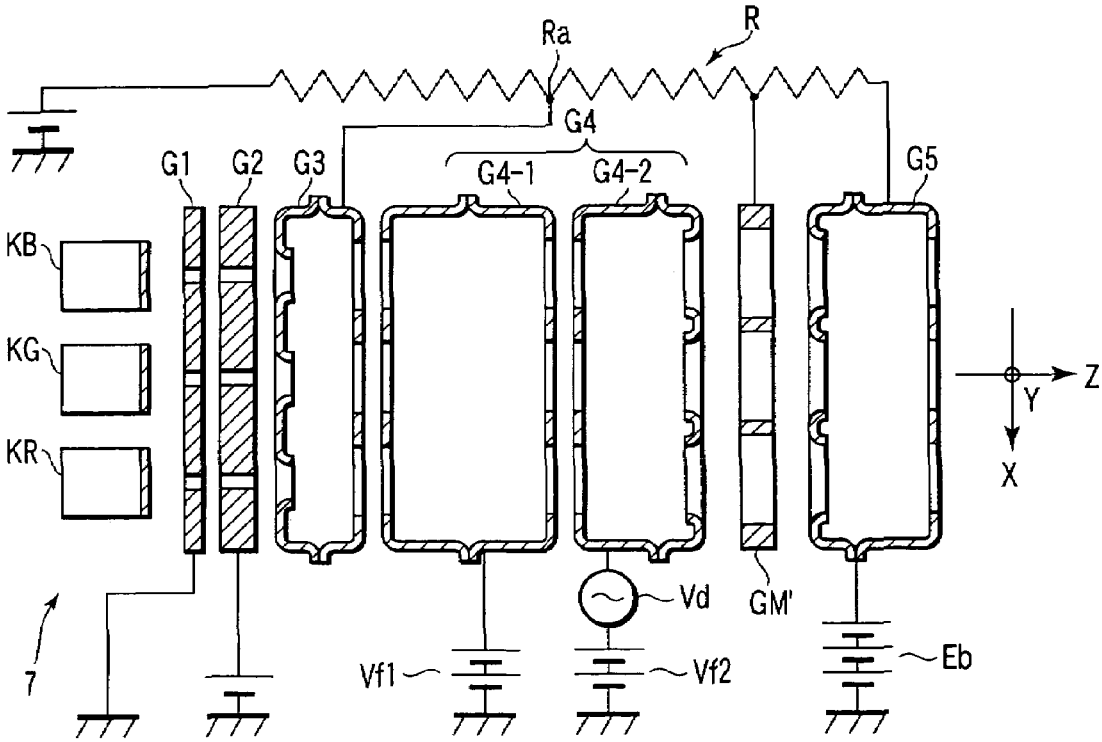
FIG. 14 is a horizontal cross-sectional view that schematically shows still another structure of the electron gun assembly, which is applicable to the cathode-ray tube apparatus shown in FIG. 1.

In the example shown in FIG. 12, the electric field extension type main lens section is created by the fourth grid G4 and fifth grid G5. Alternatively, at least one intermediate electrode may be disposed between the fourth grid G4 and fifth grid G5. For example, as shown in FIG. 14, an intermediate electrode GM' for the main lens may be disposed between the second segment G4-2 of the fourth grid G4 and the fifth grid G5. In this case, the intermediate electrode GM' is connected to the resistor R and is supplied with a voltage that is produced by dividing the anode voltage Eb. The voltage that is applied to the intermediate electrode GM' is higher than the voltage applied to the second segment G4-2 and is lower than the voltage applied to the fifth grid G5. A cylindrical electrode formed of the cylindrical body as shown in FIG. 13 may be provided on at least one of the opposed faces of the second segment G4-2, intermediate electrode GM' and fifth grid G5.

Since the main lens section is a large-aperture superimposition/extension type electron lens, the magnification can sufficiently be suppressed. Thereby, a beam spot with a still smaller size can be formed on the phosphor screen.

As has been described above, according to the cathode-ray tube apparatus of each of the embodiments, a low potential is applied to the second grid G2 of the prefocus lens section, and a potential, which is higher than the potential applied to the fourth grid G4 and is lower than the potential applied to the fifth grid G5, is applied to the third grid G3. The potential to the third grid G3 is supplied from the fifth grid G5 via the resistor R.

By virtue of a great potential difference between the second grid G2 and third grid G3, a prefocus lens section with a strong prefocusing function can be formed. Thereby, the degree of potential permeation from the third grid G3 side into the electron beam passage hole in the second grid G2 increases, and the virtual object point size becomes sufficiently small. Moreover, by the strong action of the prefocus lens section, the divergence angle of the electron beam 6 can be reduced and the electron beam, which is prior to entering the main lens section, can be reduced in size. Accordingly, the effect of spherical aberration in the main lens section can be reduced. By these functions, a beam spot with a smaller size can be formed on the phosphor screen.

The second grid G2 and third grid G3 have substantially circular electron beam passage holes, and a prefocus lens section, which is rotation-symmetric with respect to the tube axis Z, is created between these grids. As a matter of course, this prefocus lens section has no astigmatic function. Thus, even if a prefocus lens section with a strong lens action is formed, it is possible to minimize adverse effects due to possible non-uniformity in processing precision of electrodes of the prefocus lens section or possible axial displacement in assembly of the electron gun. Degradation in the beam spot shape due to these factors can be suppressed.

According to the embodiments, the electron gun assembly includes the asymmetric electron lens section that makes the horizontal dimension of the electron beam, which is prior to entering the main lens section, greater than the vertical dimension thereof.

In the case where the electric field produced between the first grid G1 and second grid G2 constitutes the asymmetric electron lens section, each of the electron beam passage holes formed in the first grid G1 is, for example, configured to have a horizontally elongated shape that is elongated in the direction of arrangement of the cathodes. Alternatively, a horizontally elongated slit, which is elongated in the direction of arrangement of the cathodes, is formed in the peripheral region of each of the electron beam passage holes formed in the first grid G1. By the effects of these configurations, the electron beam, which is prior to entering the main lens section, undergoes a stronger focusing action in the vertical direction than in the horizontal direction. Therefore, the effect of deflection aberration due to the deflection magnetic fields can be reduced, and degradation in the beam spot shape on the phosphor screen can effectively be prevented. The functional advantage can be enhanced if both the horizontally elongated holes and the horizontally elongated slits are formed in the first grid G1.

In the case where the sub-lens formed between the third grid G3 and first segment G4-1 constitutes the asymmetric electron lens, each of the electron beam passage holes formed in the high-potential-side electrode (G3) is configured to have a vertically elongated shape. Alternatively, each of the electron beam passage holes formed in the low-potential-side electrode (G4-1) is configured to have a horizontally elongated shape that is elongated in the direction of arrangement of the cathodes. Similarly, by the effects of these configurations, the electron beam, which is prior to entering the main lens section, undergoes a stronger focusing action in the vertical direction than in the horizontal direction. Therefore, the effect of deflection aberration due to the deflection magnetic fields can be reduced, and degradation in the beam spot shape on the phosphor screen can effectively be prevented. The functional advantage can be enhanced if both the vertically elongated holes in the third grid G3 and the horizontally elongated holes in the first segment G4-1 are combined.

Besides, in the sub-lens section, the intermediate electrode GM may be disposed between the third grid G3 and first segment G4-1, thereby to increase the lens power. Hence, the electron beam, which is prior to entering the main lens section, can more effectively be prefocused.

Therefore, a small-size beam spot with little distortion can be formed on the phosphor screen, and a high-definition, high-resolution image can be displayed. Even in mass-production, stable performances can be ensured.

The present invention is not limited to the above-described embodiments. At the stage of practicing the invention, various modifications and alterations may be made without departing from the spirit of the invention. The embodiments may properly be combined and practiced, if possible. In this case, advantages are obtained by the combinations.

As has been described above, the present invention can provide a cathode-ray tube apparatus capable of stably displaying a high-definition, high-resolution image.

What is claimed is:

1. A cathode-ray tube apparatus comprising:

an electron gun assembly including an electron beam generating section that generates an electron beam, a prefocus lens section that accelerates and prefocuses the electron beam generated from the electron beam generating section, a sub-lens section that further prefocuses the electron beam that is prefocused by the prefocus lens section, and a main lens section that accelerates and focuses the electron beam, which is prefocused by the sub-lens section, onto a phosphor screen; and a deflection yoke that generates deflection magnetic fields for deflecting the electron beam, which is emitted from the electron gun assembly, in a horizontal direction and a vertical direction, wherein the prefocus lens section is formed by at least a screen electrode and a first focus electrode to which a voltage with a first level is applied, and the prefocus lens section is formed in a substantially rotation-symmetric fashion with respect to a direction of travel of the electron beam, the sub-lens section is formed by at least the first focus electrode and a second focus electrode to which a voltage with a second level that is lower than the first level is applied, the main lens section is formed by at least the second focus electrode and an anode electrode to which a voltage with a third level that is higher than the first level is applied, and the electron gun assembly includes an asymmetric electron lens section that makes a horizontal dimension of the electron beam, which is prior to entering the main lens section, greater than a vertical dimension thereof.

2. The cathode-ray tube apparatus according to claim 1, wherein the electron beam generating section is formed by a cathode, a grid electrode and the screen electrode, and an electric field that is produced between the grid electrode and the screen electrode constitutes the asymmetric electron lens section.

3. The cathode-ray tube apparatus according to claim 2, wherein the grid electrode includes a horizontally elongated electron beam passage hole that has a greater horizontal dimension than a vertical dimension.

4. The cathode-ray tube apparatus according to claim 2, wherein the grid electrode includes a horizontally elongated slit at a peripheral region of an electron beam passage hole that is formed in a face of the grid electrode, which is opposed to the screen electrode.

5. The cathode-ray tube apparatus according to claim 1, wherein the sub-lens section forms the asymmetric electron lens section with astigmatism, which has a stronger focusing power in the vertical direction than in the horizontal direction.

6. The cathode-ray tube apparatus according to claim 1, wherein the first focus electrode includes a vertically elongated electron beam passage hole in a face thereof opposed to the second focus electrode.

7. The cathode-ray tube apparatus according to claim 1, wherein the second focus electrode includes a horizontally elongated electron beam passage hole in a face thereof opposed to the first focus electrode.

8. The cathode-ray tube apparatus according to claim 1, further comprising a resistor that divides the voltage applied to the anode electrode, wherein the voltage that is applied to the first focus electrode is supplied via the resistor.

9. The cathode-ray tube apparatus according to claim 1, wherein the second focus electrode comprises at least two segments, and a quadrupole lens section that has a focusing function in the horizontal direction and a diverging function in the vertical direction is formed between the segments at a time of deflecting the electron beam.

10. The cathode-ray tube apparatus according to claim 9, wherein at least one of the segments that constitute the second focus electrode is supplied with a dynamic focus voltage that is produced by superimposing an AC component, which varies in synchronism with the deflection magnetic fields, on a reference voltage.

11. The cathode-ray tube apparatus according to claim 1, wherein a cylindrical body that extends in the direction of travel of the electron beam is provided on at least one of a face of the second focus electrode, which is opposed to the anode electrode, and a face of the anode electrode, which is opposed to the second focus electrode.

12. A cathode-ray tube apparatus comprising:

an electron gun assembly including an electron beam generating section that generates an electron beam, a prefocus lens section that accelerates and prefocuses the electron beam generated from the electron beam generating section, a sub-lens section that further prefocuses the electron beam that is prefocused by the prefocus lens section, and a main lens section that accelerates and focuses the electron beam, which is prefocused by the sub-lens section, onto a phosphor screen; and a deflection yoke that generates deflection magnetic fields for deflecting the electron beam, which is emitted from the electron gun assembly, in a horizontal direction and a vertical direction, wherein the prefocus lens section is formed by at least a screen electrode and a first focus electrode to which a voltage with a first level is applied, and the prefocus lens section is formed in a substantially rotation-symmetric fashion with respect to a direction of travel of the electron beam, the sub-lens section is formed by at least the first focus electrode, a second focus electrode to which a voltage with a second level that is lower than the first level is applied, and an intermediate electrode that is disposed between the first focus electrode and the second focus electrode, the main lens section is formed by at least the second focus electrode and an anode electrode to which a voltage with a third level that is higher than the first level is applied, the intermediate electrode is electrically connected to the screen electrode, and a voltage with a fourth level that is lower than the second level is applied to the intermediate electrode and the screen electrode, and the electron gun assembly includes an asymmetric electron lens section that makes a horizontal dimension of the electron beam, which is prior to entering the main lens section, greater than a vertical dimension thereof.

13. The cathode-ray tube apparatus according to claim 12, wherein the intermediate electrode includes a horizontally elongated electron beam passage hole.

14. The cathode-ray tube apparatus according to claim 13, wherein the first focus electrode includes a vertically elongated electron beam passage hole in a face thereof opposed to the intermediate electrode, and the second focus electrode includes a vertically elongated electron beam passage hole in a face thereof opposed to the intermediate electrode.

15. The cathode-ray tube apparatus according to claim 12, wherein the electron beam generating section is formed by a cathode, a grid electrode and the screen electrode, and an electric field that is produced between the grid electrode and the screen electrode constitutes the asymmetric electron lens section.

16. The cathode-ray tube apparatus according to claim 15, wherein the grid electrode includes a horizontally elongated electron beam passage hole that has a greater horizontal dimension than a vertical dimension.

17. The cathode-ray tube apparatus according to claim 15, wherein the grid electrode includes a horizontally elongated slit at a peripheral region of an electron beam passage hole that is formed in a face of the grid electrode, which is opposed to the screen electrode.

18. The cathode-ray tube apparatus according to claim 12, wherein the sub-lens section forms the asymmetric electron lens section with astigmatism, which has a stronger focusing power in the vertical direction than in the horizontal direction.

19. The cathode-ray tube apparatus according to claim 12, further comprising a resistor that divides the voltage applied to the anode electrode, wherein the voltage that is applied to the first focus electrode is supplied via the resistor.

20. The cathode-ray tube apparatus according to claim 12, wherein the second focus electrode comprises at least two segments, and a quadrupole lens section that has a focusing function in the horizontal direction and a diverging function in the vertical direction is formed between the segments at a time of deflecting the electron beam.

21. The cathode-ray tube apparatus according to claim 20, wherein at least one of the segments that constitute the second focus electrode is supplied with a dynamic focus voltage that is produced by superimposing an AC component, which varies in synchronism with the deflection magnetic fields, on a reference voltage.

* * * * *